US010649374B2

(12) United States Patent
Mori et al.

(10) Patent No.: US 10,649,374 B2
(45) Date of Patent: May 12, 2020

(54) TRANSPORT DEVICE AND IMAGE FORMING APPARATUS

(71) Applicant: FUJI XEROX CO., LTD., Tokyo (JP)

(72) Inventors: Keitaro Mori, Kanagawa (JP); Takashi Ochi, Kanagawa (JP); Yoshiki Shimodaira, Kanagawa (JP); Toshimasa Toyama, Kanagawa (JP); Masato Yamashita, Kanagawa (JP); Takashi Ohashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/294,952

(22) Filed: Mar. 7, 2019

(65) Prior Publication Data

US 2020/0026224 A1 Jan. 23, 2020

(30) Foreign Application Priority Data

Jul. 17, 2018 (JP) ..... 2018-134014

(51) Int. Cl.
*G03G 15/16* (2006.01)
*G03G 15/20* (2006.01)

(52) U.S. Cl.
CPC ..... *G03G 15/1685* (2013.01); *G03G 15/1615* (2013.01); *G03G 15/2021* (2013.01); *G03G 2215/00139* (2013.01); *G03G 2215/1623* (2013.01)

(58) Field of Classification Search
CPC ..... G03G 15/21; G03G 2215/00139; G03G 2215/00143; G03G 2215/00156; G03G 2215/00168; B65G 15/12; B65G 15/14; B65G 39/16
See application file for complete search history.

(56) References Cited

U.S. PATENT DOCUMENTS

| | | | | |
|---|---|---|---|---|
| 9,678,459 | B2 | 6/2017 | Suzuki | |
| 2004/0154146 | A1* | 8/2004 | Pruitt, Jr. | B65H 23/0251 26/99 |
| 2011/0142502 | A1* | 6/2011 | Torimaru | G03G 15/1695 399/312 |
| 2014/0308057 | A1* | 10/2014 | Tomino | G03G 15/2017 399/341 |

(Continued)

FOREIGN PATENT DOCUMENTS

| | | |
|---|---|---|
| JP | 2002002999 | 1/2002 |
| JP | 2014029449 | 2/2014 |
| JP | 2015197635 | 11/2015 |

*Primary Examiner* — Carla J Therrien
(74) *Attorney, Agent, or Firm* — JCIPRNET

(57) ABSTRACT

A transport device includes a first belt member, a second belt member, a first roller, a second roller, a third roller, a fourth roller, a fifth roller, and a sixth roller. The second belt member is in contact with the first belt member to form a contact portion in cooperation with the first belt member. The first roller is capable of adjusting a tilt in a longitudinal direction of the first roller. The second roller is capable of adjusting a tilt in a longitudinal direction of the second roller. The third and fourth rollers are located adjacent to the first roller. The fifth and sixth rollers are located adjacent to the second roller. The third roller, the fourth roller, the fifth roller, and the sixth roller each have a uniform diameter in a longitudinal direction of the roller, and are disposed at positions other than the contact portion.

20 Claims, 4 Drawing Sheets

(56) References Cited

U.S. PATENT DOCUMENTS

| | | | | |
|---|---|---|---|---|
| 2015/0286166 | A1* | 10/2015 | Kokubo | G03G 15/1605 399/313 |
| 2016/0026125 | A1* | 1/2016 | Ishii | G03G 15/2017 399/341 |
| 2017/0129725 | A1* | 5/2017 | Sasaki | B65H 5/023 |

* cited by examiner

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2018-134014 filed Jul. 17, 2018.

BACKGROUND

(i) Technical Field

The present disclosure relates to a transport device and an image forming apparatus.

(ii) Related Art

Japanese Unexamined Patent Application Publication No. 2015-197635 describes an image forming apparatus. The image forming apparatus includes an image carrier, a toner image forming portion, which forms a toner image and causes the image carrier to carry the toner image, an endless transfer belt, which transports a recording medium, a transfer roller, which is pressed against the image carrier with the transfer belt interposed therebetween to form a transfer portion at which the toner image is transferred to the recording medium, a first stretching roller, which stretches the transfer belt at a position adjacent to and downstream of the transfer portion in a rotation direction of the transfer belt, and a second stretching roller, which stretches the transfer belt at a position adjacent to and downstream of the first stretching roller in the rotation direction of the transfer belt. The first stretching roller includes a first straight area, having a uniform diameter and disposed at the center in its rotation axis direction, and first taper areas, disposed at both ends in the rotation axis direction and having a diameter smaller than that of the first straight area and gradually decreasing toward both ends to stretch the transfer belt. The second stretching roller includes a second straight area, having a uniform diameter and disposed at the center in its rotation axis direction, and second taper areas, disposed at both ends in the rotation axis direction and having a diameter greater than that of the second straight area and gradually increasing toward both ends to stretch the transfer belt.

Japanese Unexamined Patent Application Publication No. 2002-2999 describes a belt transport device. The belt transport device includes a group of multiple rollers arranged in parallel to each other and including at least a steering roller capable of tilting to adjust winding movements, and an endless belt wound around these rollers. Portions of the belt stretched by at least two pressing-out rollers other than the steering roller serve as predetermined belt reference surfaces. The belt transport device also includes a tilt track restricting member that restricts the tilt track of the steering roller to prevent the tilting operation of the steering roller from affecting the belt reference surfaces.

Japanese Unexamined Patent Application Publication No. 2014-29449 describes a belt transport device. The belt transport device includes an endless belt, stretched and transported by multiple stretching members, a belt driving member, which transports and drives the endless belt, a tension member, which supports any one of the stretching members while allowing the stretching member to be displaced in a tension application direction to apply tension to the endless belt, a first adjusting member, which adjusts the position of a first one of the stretching members and moves a first end of the stretching member relative to a second end in a crosswise direction crossing the width direction of the endless belt, a second adjusting member, which adjusts the position of a second one of the stretching members and moves a first end of the stretching member relative to a second end in a crosswise direction crossing the width direction of the endless belt, and a controller, which controls the belt driving member to transport the endless belt and separately controls the first and second adjusting members to change the position of the endless belt in the two width directions. A coefficient of friction between the endless belt and the first one of the stretching members moved by the first adjusting member is greater than a coefficient of friction between the endless belt and the second one of the stretching members moved by the second adjusting member.

SUMMARY

In a known technology, a pair of belt-shaped members stretched around rollers move while being in contact with each other, and the positions of the respective belt-shaped members in the longitudinal directions are controlled while adjusting the tilts, in the longitudinal direction, of the rollers that support the respective belt-shaped members. In such a technology, when a first one of the belt-shaped members moves in the longitudinal direction of the corresponding roller, a second belt-shaped member may also move in association with the movement of the first belt-shaped member.

Aspects of non-limiting embodiments of the present disclosure relate to a transport device and an image forming apparatus capable of restricting movement of one of belt-shaped members in association with movement of another belt-shaped member, unlike in the case where a roller adjacent to a roller around which belt-shaped members are stretched and capable of adjusting a tilt has a ununiform diameter, or in the case where a roller adjacent to a roller capable of adjusting a tilt is located at a contact portion.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transport device that includes a first belt member movably stretched, a second belt member, a first roller, a second roller, a third roller, a fourth roller, a fifth roller, and a sixth roller. The second belt member is in contact with the first belt member to form a contact portion in cooperation with the first belt member. The second belt member is movably stretched. The first roller stretches the first belt member and is capable of adjusting a tilt in a longitudinal direction of the first roller. The second roller stretches the second belt member and is capable of adjusting a tilt in a longitudinal direction of the second roller. The third roller stretches the first belt member and is located adjacent to the first roller and upstream of the first roller in a movement direction of the first belt member. The fourth roller stretches the first belt member and is located adjacent to the first roller and downstream of the first roller in the movement direction of the first belt member. The fifth roller stretches the second belt member and is located adjacent to the second roller and upstream of the second roller in a movement direction of the second belt member. The sixth roller stretches the second belt member and is located adjacent to the second roller and downstream of the second roller in the movement direction of the second belt member. The third roller, the fourth roller, the fifth roller, and the sixth roller each have a uniform diameter in a longitudinal direction of the roller, and are disposed at positions other than the contact portion.

BRIEF DESCRIPTION OF THE DRAWINGS

Exemplary embodiments of the present disclosure will be described in detail based on the following figures, wherein.

DETAILED DESCRIPTION

Figure 1:
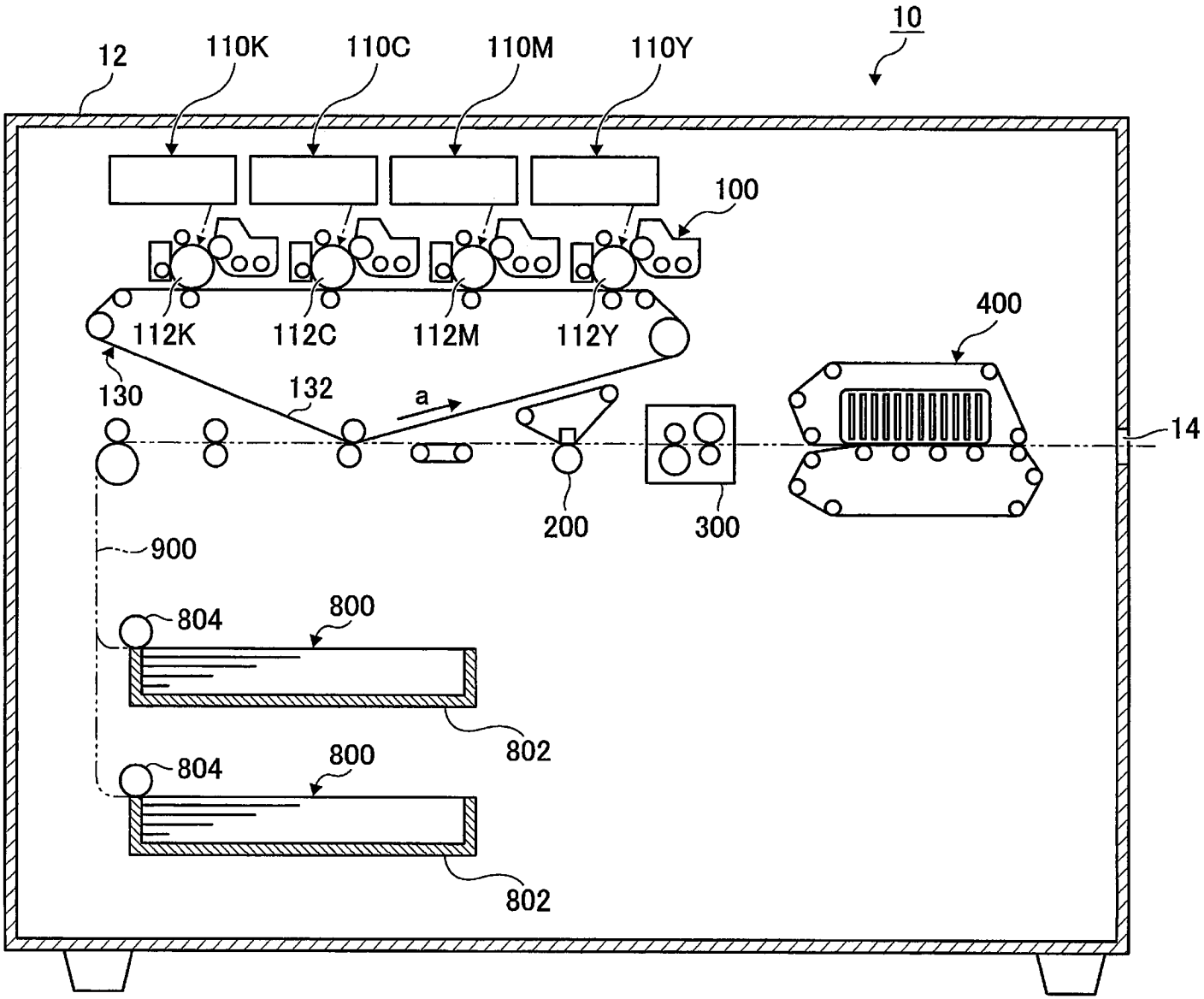
FIG. 1 illustrates a structure of an image forming apparatus according to an embodiment of the present disclosure.

Exemplary embodiments of the present disclosure are described now with reference to the drawings. FIG. 1 illustrates an image forming apparatus 10 according to an exemplary embodiment of the present disclosure. As illustrated in FIG. 1, the image forming apparatus 10 includes an image forming apparatus body 12. The image forming apparatus body 12 includes an outlet port 14 to which sheets, used as examples of a recording medium, are discharged.

The image forming apparatus body 12 includes a transport path 900, along which sheets are transported. The image forming apparatus body 12 accommodates, along the transport path 900 in order from the upstream side in a sheet transport direction, for example, two sheet feeding devices 800, image forming portions 100, which form toner images transferred to and fixed on the sheets fed from the sheet feeding devices 800, a fixing device 200, which fixes toner images formed by the image forming portions 100 and transferred to the sheets onto the sheets, a uncurling device 300, which corrects a curl of sheets to which toner images are fixed by the fixing device 200, and a cooling device 400, which cools sheets transported thereto from the uncurling device 300 and which is an example of a transport device.

The sheet feeding devices 800 each include a sheet container 802 and a feeding device 804, which feeds the uppermost one of the sheets accommodated in the sheet container 802 to the transport path 900.

The image forming portions 100 respectively include photoconductor drums 112Y, 112M, 112C, and 112K, used as image carriers, and a yellow toner image forming unit 110Y, a magenta toner image forming unit 110M, a cyan toner image forming unit 110C, and a black toner image forming unit 110K, which respectively form yellow toner images, magenta toner images, cyan toner images, and black toner images on the surfaces of the photoconductor drums 112Y, 112M, 112C, and 112K. The yellow toner image forming unit 110Y, the magenta toner image forming unit 110M, the cyan toner image forming unit 110C, and the black toner image forming unit 110K will be described in detail, below.

The image forming portions 100 also include a transfer device 130, and the transfer device 130 includes an intermediate transfer belt 132. The intermediate transfer belt 132 is used as a transfer body to which toner images are transferred, and rotates in the direction of arrow a in FIG. 1. The intermediate transfer belt 132 has toner images that have been formed on the photoconductor drums 112Y, 112M, 112C, and 112K transferred thereto in a superposed manner, and the toner images transferred in a superposed manner are further transferred from the intermediate transfer belt 132 to sheets transported from the sheet containers 802 along the transport path 900.

The fixing device 200 is a device that fixes the toner images transferred to sheets onto the sheets using, for example, heat.

The uncurling device 300 is a device that corrects curls of sheets curled by, for example, being heated by the fixing device 200.

The cooling device 400 is an example of a transport device, as described above, and cools sheets having a high temperature by being heated by the fixing device 200 while transporting the sheets. When the cooling device 400 cools the sheets, the toner images fixed onto the sheets are also cooled. Thus, the toner images fixed onto the sheets and that have once melted with heat are no longer melted, so that adjacent ones of the sheets carrying the toner images no longer adhere to each other with melted toner even when stacked one on another. The cooling device 400 is described in detail, later.

The transport path 900 is used for transporting sheets from the sheet feeding devices 800 to the image forming portions 100, for transporting sheets from the image forming portions 100 to the fixing device 200, for transporting sheets from the fixing device 200 to the uncurling device 300, for transporting sheets from the uncurling device 300 to the cooling device 400, and for discharging the sheets cooled by the cooling device 400 out of the image forming apparatus body 12.

Figure 2:
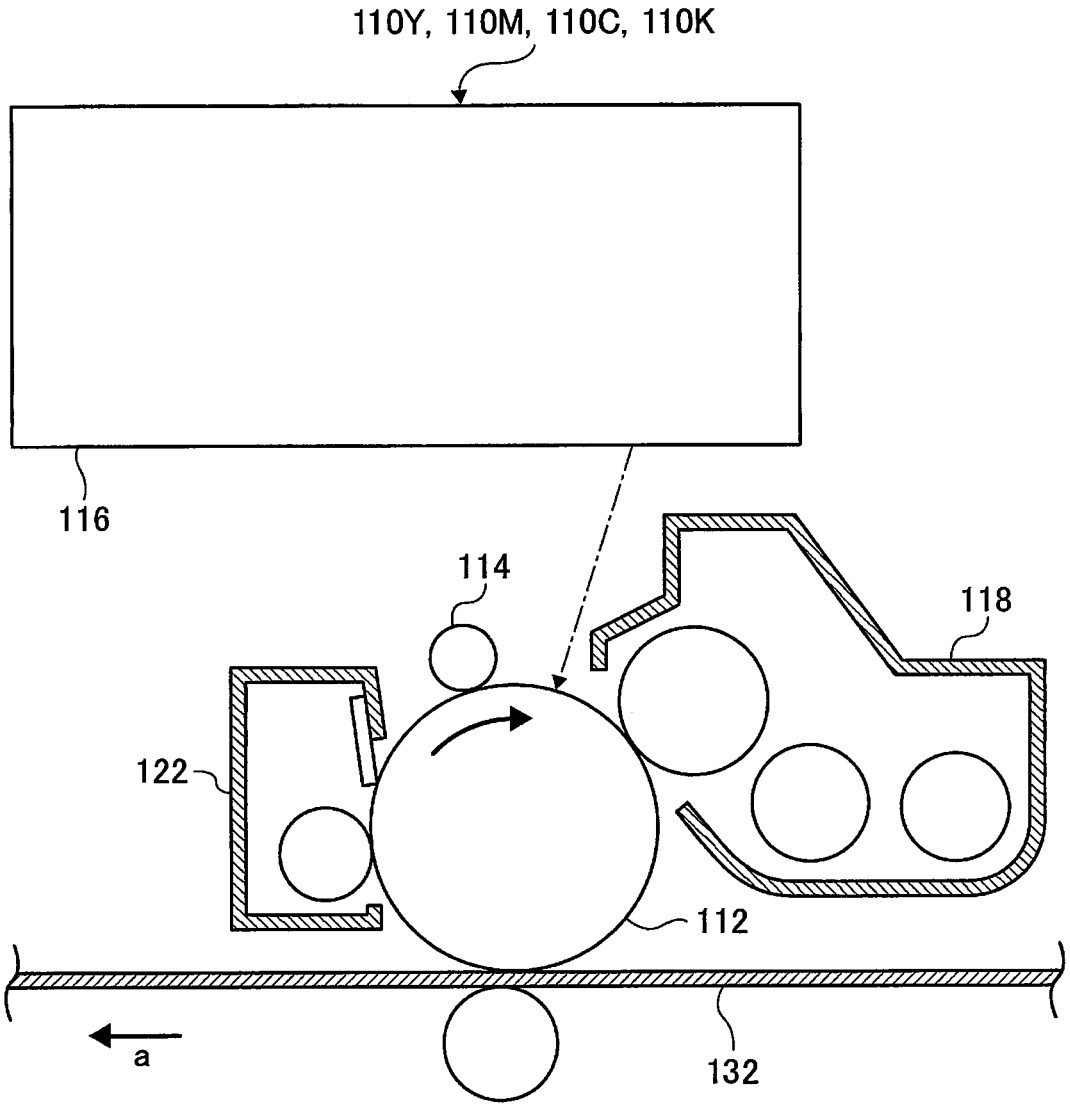
FIG. 2 illustrates a structure of a toner image forming portion included in the image forming apparatus illustrated in FIG. 1.

FIG. 2 illustrates toner image forming units 110Y, 110M, 110C, and 110K. Although using toner of different colors and forming images of different colors, the toner image forming units 110Y, 110M, 110C, and 110K have the same structure, and thus are collectively referred to as toner image forming units 110. As illustrated in FIG. 2, each toner image forming unit 110 includes a charging device 114, which electrically charges the surface of a photoconductor drum 112, a latent image forming device 116, which irradiates the surface of the photoconductor drum 112 electrically charged by the charging device 114 with light to form a latent image on the surface of the photoconductor drum 112, a developing device 118, which develops a latent image formed on the surface of the photoconductor drum 112 by the latent image forming device 116 with toner, and a cleaning device 122, which cleans the surface of the photoconductor drum 112 from which the toner image has been transferred to the intermediate transfer belt 132.

Figure 3:
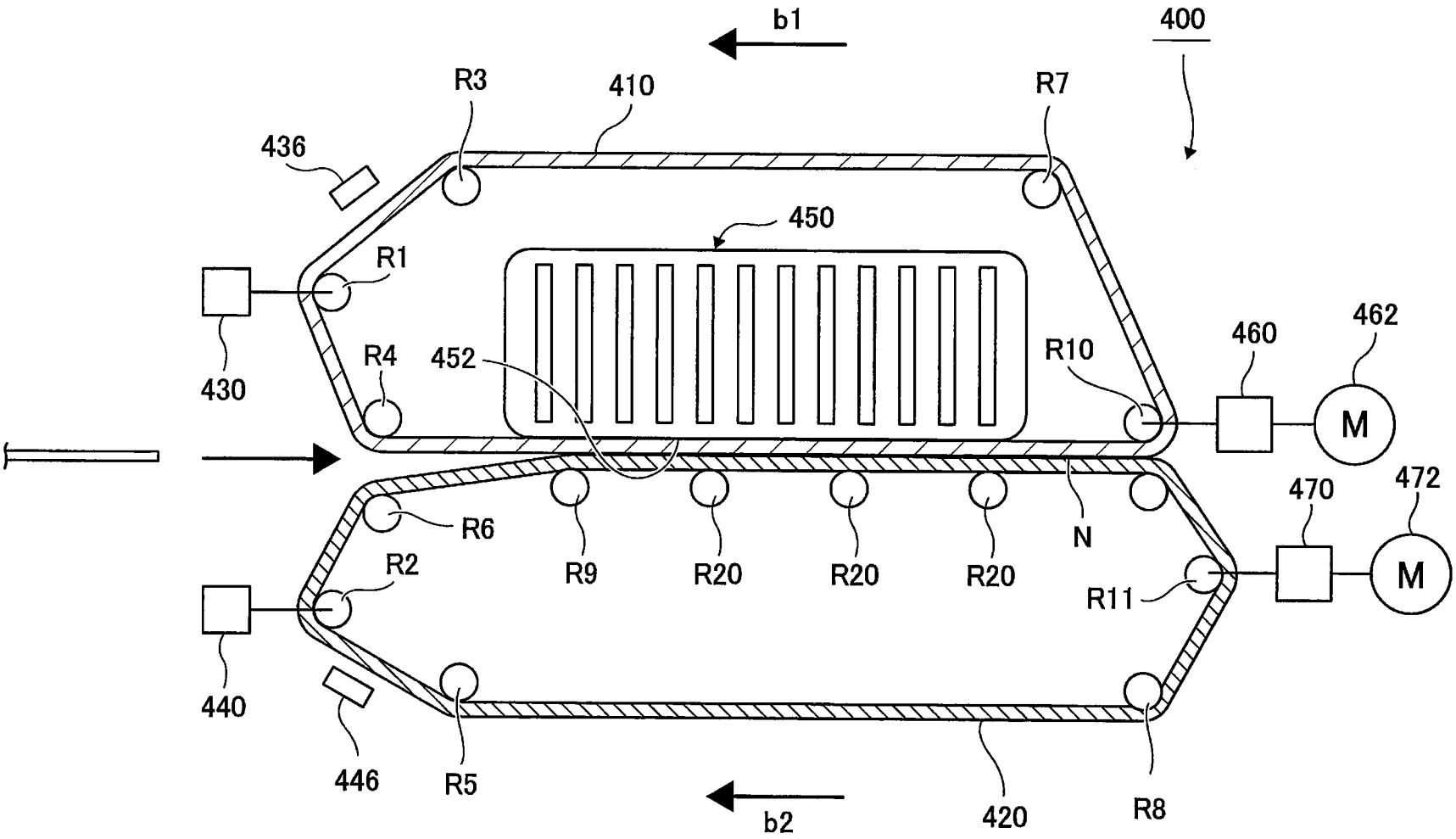
FIG. 3 illustrates a structure of a cooling device included in the image forming apparatus illustrated in FIG. 1.
Figure 4:
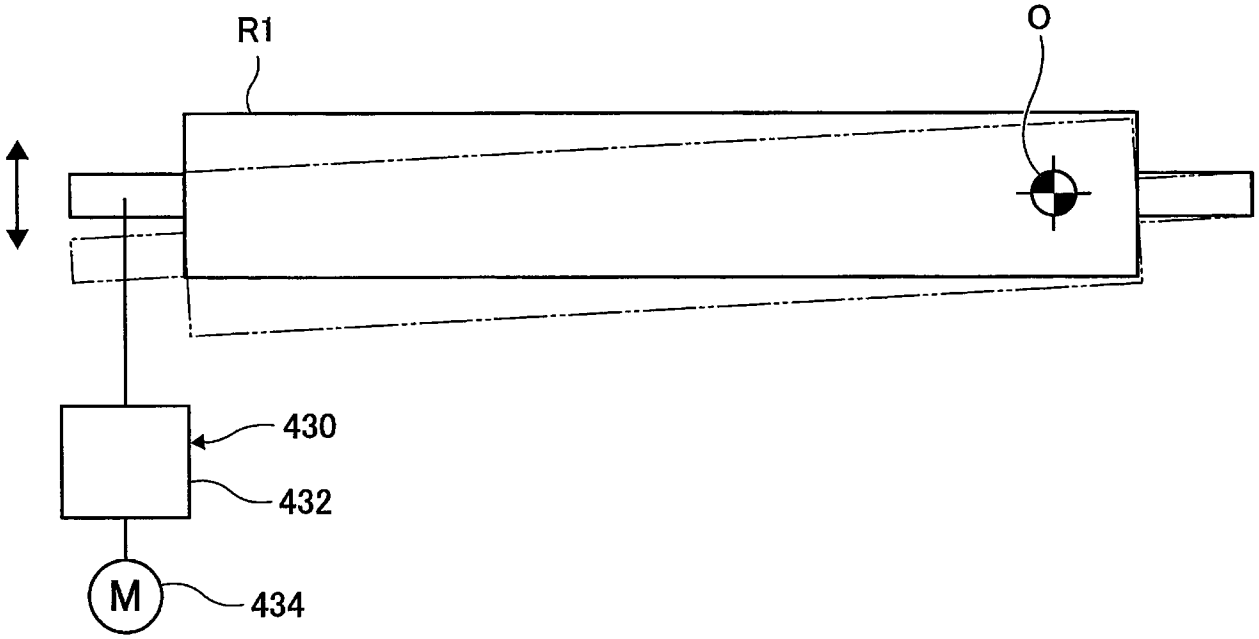
FIG. 4 illustrates a structure of an adjusting device included in the image forming apparatus illustrated in FIG. 3.

FIG. 3 illustrates the cooling device 400. As illustrated in FIG. 4, the cooling device 400 includes a first belt member 410. The first belt member 410 is an example of a first belt member movably stretched. Arrow b1 illustrated in FIG. 3 denotes a movement direction of the first belt member 410.

The cooling device 400 also includes a second belt member 420. The second belt member 420 is an example of a second belt member. The second belt member 420 is in contact with the first belt member 410, forms a contact portion N in cooperation with the first belt member 410, and is movably stretched. Arrow b2 illustrated in FIG. 3 denotes the movement direction of the second belt member 420.

The cooling device 400 also includes a first roller R1. The first roller R1 stretches the first belt member 410. The first roller R1 is capable of adjusting tilts in the longitudinal direction. Specifically, the first roller R1 has a first adjusting device 430 attached thereto, and the first adjusting device 430 is capable of adjusting tilts in the longitudinal direction of the first roller R1. The first roller R1 is an example of a first roller.

The first adjusting device 430 is controlled to tilt in such a direction as to reduce displacement in the direction crossing the transport direction of the first belt member 410 on the basis of outputs of a detector 436, which detects the position of the first belt member 410 in the direction crossing the transport direction. The first adjusting device 430 is described in detail, below.

The cooling device 400 also includes a second roller R2. The second roller R2 stretches the second belt member 420. The second roller R2 is capable of adjusting tilts in the longitudinal direction. Specifically, the second roller R2 has a second adjusting device 440 attached thereto, and the second adjusting device 440 is capable of adjusting tilts in the longitudinal direction of the second roller R2. The second roller R2 is an example of a second roller.

The second adjusting device 440 is controlled to tilt in such a direction as to reduce displacement in the direction crossing the transport direction of the second belt member 420 on the basis of outputs of a detector 446, which detects the position of the second belt member 420 in the direction crossing the transport direction. The second adjusting device 440 is described in detail, below.

The cooling device 400 also includes a third roller R3. The third roller R3 stretches the first belt member 410, and is located adjacent to the first roller R1, and upstream of the first roller R1 in the movement direction of the first belt member 410. The third roller R3 is an example of a third roller.

The cooling device 400 also includes a fourth roller R4. The fourth roller R4 stretches the first belt member 410, and is located adjacent to the first roller R1, and downstream of the first roller R1 in the movement direction of the first belt member 410. The fourth roller R4 is an example of a fourth roller.

The cooling device 400 also includes a fifth roller R5. The fifth roller R5 stretches the second belt member 420, and is located adjacent to the second roller R2, and upstream of the second roller R2 in the movement direction of the second belt member 420. The fifth roller R5 is an example of a fifth roller.

The cooling device 400 also includes a sixth roller R6. The sixth roller R6 stretches the second belt member 420, and is located adjacent to the second roller R2, and downstream of the second roller R2 in the movement direction of the second belt member 420. The sixth roller R6 is an example of a sixth roller.

In the cooling device 400, the third roller R3, the fourth roller R4, the fifth roller R5, and the sixth roller R6 each have a uniform diameter in the longitudinal direction, and located at positions other than the contact portion N. Here, a uniform diameter in the longitudinal direction does not require a diameter having a completely uniform diameter in the longitudinal direction, and includes a diameter having a variation in the longitudinal direction within an allowable range. More specifically, a uniform diameter in the longitudinal direction includes a diameter that varies less than 0.2 mm between the center and the ends in the longitudinal direction.

As described above, in the cooling device 400, the diameter of the third roller R3 and the diameter of the fourth roller R4 are uniform in the longitudinal direction. Thus, for example, the contact area between the first roller R1 and the first belt member 410 is larger than that in the case where a roller with a diameter larger at the center in the longitudinal direction than at both ends in the longitudinal direction or a roller with a diameter smaller at the center in the longitudinal direction than at both ends in the longitudinal direction is used as at least one of the third roller R3 and the fourth roller R4. Thus, the first belt member 410 is more likely to follow changes of the angle of the first roller R1.

As described above, in the cooling device 400, the diameter of the fifth roller R5 and the diameter of the sixth roller R6 are uniform in the longitudinal direction. Thus, for example, the contact area between the second roller R2 and the second belt member 420 is larger than that in the case where a roller having a diameter larger at the center in the longitudinal direction than at both ends in the longitudinal direction or a roller having a diameter larger at the center in the longitudinal direction than at both ends in the longitudinal direction is used as at least one of the fifth roller R5 and the sixth roller R6. Thus, the second belt member 420 is more likely to follow changes of the angle of the second roller R2.

As described above, in the cooling device 400, the third roller R3 and the fourth roller R4 are disposed at portions other than the contact portion N. Thus, distortion of the first belt member 410 that occurs when the angle of the first roller R1 is changed is less likely to occur than in the case where at least one of the third roller R3 and the fourth roller R4 is disposed at the contact portion N. Thus, the first belt member 410 is more likely to follow changes of the angle of the first roller R1.

As described above, in the cooling device 400, the fifth roller R5 and the sixth roller R6 are disposed at portions other than the contact portion N. Thus, distortion of the second belt member 420 that occurs when the angle of the second roller R2 is changed is less likely to occur than in the case where at least one of the fifth roller R5 and the sixth roller R6 is disposed at the contact portion N. Thus, the second belt member 420 is more likely to follow changes of the angle of the second roller R2.

In the cooling device 400, the first roller R1 has a larger contact area, over which it comes into contact with the first belt member 410, than the third roller R3 and the fourth roller R4. Thus, the first belt member 410 is more likely to follow changes of the angle of the first roller R1 than in the case where the first roller R1 has a smaller contact area, over which it comes into contact with the first belt member 410, than the third roller R3 and the fourth roller R4, or in the case where the first roller R1 has the same contact area, over which it comes into contact with the first belt member 410, as the third roller R3 and the fourth roller R4.

In the cooling device 400, the second roller R2 has a larger contact area, over which it comes into contact with the second belt member 420, than the fifth roller R5 and the sixth roller R6. Thus, the second belt member 420 is more likely to follow changes of the angle of the second roller R2 than in the case where the second roller R2 has a smaller contact area, over which it comes into contact with the second belt member 420, than the fifth roller R5 and the sixth roller R6, or in the case where the second roller R2 has the same contact area, over which it comes into contact with the second belt member 420, as the fifth roller R5 and the sixth roller R6.

The cooling device 400 also includes a seventh roller R7. The seventh roller R7 stretches the first belt member 410, and is disposed adjacent to the third roller R3 and upstream of the third roller R3 in the movement direction of the first belt member 410. The seventh roller R7 stretches the first belt member 410 at a position other than the position at which the first belt member 410 forms the contact portion N. The seventh roller R7 is an example of a seventh roller.

The cooling device 400 also includes an eighth roller R8. The eighth roller R8 stretches the second belt member 420, and is located adjacent to the fifth roller R5, and upstream of the fifth roller R5 in the movement direction of the second belt member 420. The eighth roller R8 stretches the second belt member 420 at a position other than the position at which the second belt member 420 forms the contact portion N. The eighth roller R8 is an example of an eighth roller.

The seventh roller R7 and the eighth roller R8 each have a diameter that varies in the longitudinal direction. Here, examples of a roller that has a diameter varying in the longitudinal direction include a so-called crown roller, in which the diameter at both ends is smaller than that at the center in the longitudinal direction, and a so-called flare roller, in which the diameter at both ends is smaller than that at the center in the longitudinal direction.

Thus, in the cooling device 400, compared to the case where a roller having a uniform diameter in the longitudinal direction is used as the seventh roller R7, the first belt member 410 more easily moves in the direction crossing the movement direction of the first belt member 410. In the cooling device 400, compared to the case where a roller having a uniform diameter in the longitudinal direction is used as the eighth roller R8, the second belt member 420 more easily moves in the direction crossing the movement direction of the second belt member 420.

In the cooling device 400, the seventh roller R7 and the eighth roller R8 have the same shape. Thus, in the cooling device 400, compared to the case where the seventh roller R7 and the eighth roller R8 have different shapes, the movement of the first belt member 410 in the direction crossing the sheet transport direction is as smooth as the movement of the second belt member 420 in the direction crossing the sheet transport direction.

The cooling device 400 also includes a heat radiating portion 450. The heat radiating portion 450 is an example of a tension member. The heat radiating portion 450 stretches the first belt member 410, and is located adjacent to the fourth roller R4, and downstream of the fourth roller R4 in the movement direction of the first belt member 410. The heat radiating portion 450 includes a contact surface 452, which comes into contact with the first belt member 410. The heat radiating portion 450, which is a so-called heat sink, cools the first belt member 410 to cool the sheet transported while being in contact with the first belt member 410 and the toner image fixed to the sheet. The heat radiating portion 450 is an example of a tension member.

The cooling device 400 also includes a ninth roller R9. The ninth roller R9 is located adjacent to the sixth roller R6 and downstream of the sixth roller R6 in the movement direction of the second belt member 420. The ninth roller R9 is an example of a pinch roller, and has a uniform diameter in the longitudinal direction. Here, as in the case of, for example, the third roller R3, a uniform diameter does not require a diameter having a completely uniform diameter in the longitudinal direction, and includes a diameter having a variation in the longitudinal direction within an allowable range. The ninth roller R9 is an example of a ninth roller.

In the cooling device 400, the contact portion N starts extending from the position at which the heat radiating portion 450 and the ninth roller hold the first belt member 410 and the second belt member 420 therebetween. Thus, in the cooling device 400, displacement of the position at which the contact portion N is formed is reduced further than in the case where the contact portion N starts extending from the position at which the ninth roller R9 and one roller that stretches the first belt member 410 hold the first belt member 410 and the second belt member 420 therebetween.

The cooling device 400 includes, for example, three pinch rollers R20. As in the case of the ninth roller R9, the pinch rollers R20 hold the first belt member 410 and the second belt member 420 between themselves and the contact surface 452 of the heat radiating portion 450. As in the case of the ninth roller R9, the pinch rollers R20 each have a uniform diameter in the longitudinal direction. Here, as in the case of, for example, the third roller R3 or the ninth roller R9, a uniform diameter does not require a diameter having a completely uniform diameter in the longitudinal direction, and includes a diameter having a variation in the longitudinal direction within an allowable range.

The cooling device 400 also includes a tenth roller R10. The tenth roller R10 stretches the first belt member 410 and transmits driving force to the first belt member 410. A driving source 462, such as a motor, is coupled to the tenth roller R10 with a driving-force transmission device 460, formed of a gear train or another device, interposed therebetween. The tenth roller R10 is driven upon receipt of a driving force transmitted from the driving source 462. The tenth roller R10 is an example of a tenth roller.

The tenth roller R10 has a uniform diameter in the longitudinal direction. As in the case of, for example, the third roller R3, a uniform diameter does not require a diameter having a completely uniform diameter in the longitudinal direction, and includes a diameter having a variation in the longitudinal direction within an allowable range.

The cooling device 400 also includes an eleventh roller R11. The eleventh roller R11 stretches the second belt member 420 and transmits a driving force to the second belt member 420. A driving source 472, such as a motor, is coupled to the eleventh roller R11 with a driving-force transmission device 470, formed of a gear train or another device, interposed therebetween. The eleventh roller R11 is driven upon receipt of a driving force transmitted from the driving source 472. The eleventh roller R11 is an example of an eleventh roller.

The eleventh roller R11 has a uniform diameter in the longitudinal direction. Here, as in the case of the third roller R3 and other rollers, a uniform diameter does not require a diameter having a completely uniform diameter in the longitudinal direction, and includes a diameter having a variation in the longitudinal direction within an allowable range.

As illustrated in FIG. 3, in the cooling device 400, the third roller R3, the fourth roller R4, the fifth roller R5, and the sixth roller R6 are located at positions other than the contact portion N.

FIG. 4 illustrates the first adjusting device 430. As illustrated in FIG. 4, the first adjusting device 430 includes a driving-force transmission mechanism 432 and an actuator 434. The actuator 434 is coupled to a first end of the first roller R1 in the longitudinal direction with the driving transmission mechanism 432 interposed therebetween. When the driving force from the actuator 434 is transmitted to the first roller R1, the first adjusting device 430 adjusts a tilt of the first roller R1 by rotating the first roller R1 about the center O.

The structure of the second adjusting device 440 is the same as that of the first adjusting device 430, and thus is not described. The second adjusting device 440 adjusts a tilt of the second roller R2, in the same manner as the first adjusting device 430 adjusts a tilt of the first roller R1.

In the above, a case where the cooling device 400 is used as an example of the transport device and the cooling device 400 transports a sheet on which an image is formed at the image forming portions 100 is described. However, the transport device may transport a sheet on which an image is formed to the image forming portions 100.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport device, comprising:

a first belt member movably stretched;

a second belt member that is in contact with the first belt member to form a contact portion in cooperation with the first belt member, the second belt member being movably stretched;

a first roller that stretches the first belt member and that is capable of adjusting a tilt in a longitudinal direction of the first roller;

a second roller that stretches the second belt member and that is capable of adjusting a tilt in a longitudinal direction of the second roller;

a third roller that stretches the first belt member and that is located adjacent to the first roller and upstream of the first roller in a movement direction of the first belt member;

a fourth roller that stretches the first belt member and that is located adjacent to the first roller and downstream of the first roller in the movement direction of the first belt member;

a fifth roller that stretches the second belt member and that is located adjacent to the second roller and upstream of the second roller in a movement direction of the second belt member;

a sixth roller that stretches the second belt member and that is located adjacent to the second roller and downstream of the second roller in the movement direction of the second belt member; and a tension member that stretches the first belt member and that is located adjacent to the fourth roller and downstream of the fourth roller in the movement direction of the first belt member, wherein the third roller, the fourth roller, the fifth roller, and the sixth roller each have a uniform diameter in a longitudinal direction of the roller, and are disposed at positions other than the contact portion, wherein the third roller and the fourth roller are disposed at one side of the tension member.

2. The transport device according to claim 1, wherein the first roller has a larger contact area, over which the first roller comes into contact with the first belt member, than the third roller and the fourth roller, and wherein the second roller has a larger contact area, over which the second roller comes into contact with the second belt member, than the fifth roller and the sixth roller.

3. The transport device according to claim 2, further comprising:

a seventh roller that stretches the first belt member and that is located adjacent to the third roller and upstream of the third roller in the movement direction of the first belt member; and an eighth roller that stretches the second belt member and that is located adjacent to the fifth roller and upstream of the fifth roller in the movement direction of the second belt member.

4. The transport device according to claim 3, wherein the seventh roller and the eighth roller are similarly shaped.

5. The transport device according to claim 3, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

6. The transport device according to claim 2, further comprising:

a seventh roller that stretches the first belt member at a position other than a position at which the contact portion is formed; and an eighth roller that stretches the second belt member at a position other than a position at which the contact portion is formed.

7. The transport device according to claim 6, wherein the seventh roller and the eighth roller are similarly shaped.

8. The transport device according to claim 6, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

9. The transport device according to claim 2, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

10. The transport device according to claim 1, further comprising:

a seventh roller that stretches the first belt member and that is located adjacent to the third roller and upstream of the third roller in the movement direction of the first belt member; and an eighth roller that stretches the second belt member and that is located adjacent to the fifth roller and upstream of the fifth roller in the movement direction of the second belt member.

11. The transport device according to claim 10, wherein the seventh roller and the eighth roller are similarly shaped.

12. The transport device according to claim 10, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

13. The transport device according to claim 1, further comprising:

a seventh roller that stretches the first belt member at a position other than a position at which the contact portion is formed; and an eighth roller that stretches the second belt member at a position other than a position at which the contact portion is formed.

14. The transport device according to claim 13, wherein the seventh roller and the eighth roller are similarly shaped.

15. The transport device according to claim 13, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

16. The transport device according to claim 1, further comprising:

a ninth roller that is located adjacent to the sixth roller and downstream of the sixth roller in the movement direction of the second belt member, wherein the contact portion extends from a position at which the tension member and the ninth roller hold the first belt member and the second belt member therebetween.

17. The transport device according to claim 1, further comprising:

a pinch roller that holds the first belt member and the second belt member between the pinch roller and the contact surface, wherein the pinch roller has a uniform diameter in a longitudinal direction, wherein the tension member has a contact surface over which the tension member comes into contact with the first belt member.

18. The transport device according to claim 1, further comprising:

a tenth roller that stretches the first belt member and transmits a driving force to the first belt member; and an eleventh roller that stretches the second belt member and transmits a driving force to the second belt member, wherein the tenth roller and the eleventh roller each have a uniform diameter in a longitudinal direction.

19. The transport device according to claim 1, further comprising:

a seventh roller that stretches the first belt member and that is disposed at a position away from the contact portion.

20. An image forming apparatus, comprising:

an image forming portion that forms an image on a recording medium; and a transport device that transports a recording medium on which an image is formed by the image forming portion or a recording medium on which an image has been formed by the image forming portion, wherein the transport device includes a first belt member movably stretched, a second belt member that is in contact with the first belt member to form a contact portion in cooperation with the first belt member, the second belt member being movably stretched, a first roller that stretches the first belt member and that is capable of adjusting a tilt in a longitudinal direction of the first roller, a second roller that stretches the second belt member and that is capable of adjusting a tilt in a longitudinal direction of the second roller, a third roller that stretches the first belt member and that is located adjacent to the first roller and upstream of the first roller in a movement direction of the first belt member, a fourth roller that stretches the first belt member and that is located adjacent to the first roller and downstream of the first roller in the movement direction of the first belt member, a fifth roller that stretches the second belt member and that is located adjacent to the second roller and upstream of the second roller in a movement direction of the second belt member, a sixth roller that stretches the second belt member and that is located adjacent to the second roller and downstream of the second roller in the movement direction of the second belt member, and a tension member that stretches the first belt member and that is located adjacent to the fourth roller and downstream of the fourth roller in the movement direction of the first belt member, wherein the third roller, the fourth roller, the fifth roller, and the sixth roller each have a uniform diameter in a longitudinal direction of the roller, and are disposed at positions other than the contact portion, wherein the third roller and the fourth roller are disposed at one side of the tension member.

* * * * *